US011457731B2

(12) United States Patent
Huang et al.

(10) Patent No.: US 11,457,731 B2
(45) Date of Patent: Oct. 4, 2022

(54) HINDERED-TO-FLIP-UP STRUCTURE FOR DESKTOP LIFTING PLATFORM, AND CORRESPONDING DESKTOP LIFTING PLATFORM

(71) Applicant: ZHEJIANG JIECANG LINEAR MOTION TECHNOLOGY CO., LTD., Zhejiang (CN)

(72) Inventors: Zhiyou Huang, Zhejiang (CN); Zhuangyan Rong, Zhejiang (CN); Quanquan Fei, Zhejiang (CN)

(73) Assignee: ZHEJIANG JIECANG LINEAR MOTION TECHNOLOGY CO., LTD., Zhejiang (CN)

( * ) Notice: Subject to any disclaimer, the term of this patent is extended or adjusted under 35 U.S.C. 154(b) by 48 days.

(21) Appl. No.: 16/705,247

(22) Filed: Dec. 6, 2019

(65) Prior Publication Data

US 2020/0178685 A1 Jun. 11, 2020

Related U.S. Application Data

(60) Provisional application No. 62/775,927, filed on Dec. 6, 2018.

(51) Int. Cl.
*A47B 21/04* (2006.01)
*A47B 21/02* (2006.01)

(52) U.S. Cl.
CPC ..... *A47B 21/04* (2013.01); *A47B 21/02* (2013.01)

(58) Field of Classification Search
CPC ..... A47B 21/04; A47B 21/02; Y10S 248/92; Y10S 248/922; Y10S 248/923
See application file for complete search history.

(56) References Cited

U.S. PATENT DOCUMENTS

| | | | | |
|---|---|---|---|---|
| 7,036,787 | B1 * | 5/2006 | Lin | F16M 11/10 248/123.11 |
| 9,279,537 | B2 * | 3/2016 | Hung | F16M 11/18 |
| 9,717,328 | B1 * | 8/2017 | Tsai | F16M 11/18 |
| 9,915,394 | B2 * | 3/2018 | Chen | F16M 11/28 |
| 10,376,042 | B1 * | 8/2019 | Johnson | A47B 21/06 |
| 2004/0251389 | A1 * | 12/2004 | Oddsen, Jr. | F16M 11/2092 248/279.1 |
| 2007/0145203 | A1 * | 6/2007 | Takada | F16M 11/2092 248/162.1 |

(Continued)

*Primary Examiner* — Eret C McNichols
(74) *Attorney, Agent, or Firm* — JCIPRNET

(57) ABSTRACT

Disclosed is a hindered-to-flip-up structure for a desktop lifting platform, wherein the desktop lifting platform includes a lifting column, and a supporting plate that rises or descends with the lifting column; the hindered-to-flip-up structure is disposed on the supporting plate; the supporting plate includes a fixing plate and a flip plate in rotatable connection with the fixing plate; a limiting device is provided on the supporting plate; when the flip plate rotates downwardly, the limiting device limits the flip plate from downward rotation; the flip plate is free to rotate upwardly. Further disclosed is a desktop lifting platform adopting the hindered-to-flip-up structure. The disclosures offer advantages of better protecting the desktop lifting platform and protecting items on the desk from being excessively crushed and crashed. The disclosures are mainly placed on a work platform such as a desk.

10 Claims, 3 Drawing Sheets

(56) References Cited

U.S. PATENT DOCUMENTS

| | | | | |
|---|---|---|---|---|
| 2007/0195495 | A1* | 8/2007 | Kim | F16M 11/24 361/679.07 |
| 2011/0147547 | A1* | 6/2011 | Fitzpatrick | F16M 11/10 248/157 |
| 2012/0119040 | A1* | 5/2012 | Ergun | A47B 9/10 248/126 |
| 2014/0034799 | A1* | 2/2014 | Fallows | F16M 11/425 248/297.21 |
| 2018/0020825 | A1* | 1/2018 | Hung | A47B 21/04 108/31 |
| 2018/0255920 | A1* | 9/2018 | Currie | A47B 21/04 |

* cited by examiner

HINDERED-TO-FLIP-UP STRUCTURE FOR DESKTOP LIFTING PLATFORM, AND CORRESPONDING DESKTOP LIFTING PLATFORM

CROSS-REFERENCE TO RELATED APPLICATION

This application claims the priority benefit of U.S. provisional application Ser. No. 62/775,927, filed on Dec. 6, 2018. The entirety of the above-mentioned patent application is hereby incorporated by reference herein and made a part of this specification.

BACKGROUND

Technical Field

The present disclosure relates to desk accessory equipment, and more particularly relates to a hindered-to-flip-up structure for a desktop lifting platform, and a corresponding desktop lifting platform.

Description of Related Art

Lifting desks are commonly used in current life and work. In the market, there also emerge some desktop accessory products which may be placed on desktop and lifted independently. Such accessory products are also referred to as desktop lifting platforms. For example, the Chinese invention patent CN108552748A discloses such a desktop lifting platform, the desktop lifting platform generally comprising: a base, a lifting column, and a desktop board, wherein the base is placed or installed on a desk, and the desktop board may be lifted or descended with the lifting column.

However, conventional desktop lifting platforms have certain drawbacks during actual use. For example, if there are items placed on the desk, such items may be pressed by the desktop board during the descending process, which, on the one hand, potentially damages the items, and on the other hand, possibly causes overload of the electric motor in the lifting platform, thereby damaging the desktop lifting platform.

SUMMARY

To overcome the drawbacks in the prior art, the present disclosure provides a hindered-to-flip-up structure for a desktop lifting platform, and a corresponding desktop lifting platform, which may better protect the desktop lifting platform and protect the items on the desk from being excessively crushed and crashed.

To solve the technical problems above, the present disclosure adopts a technical solution below:

A hindered-to-flip-up structure for a desktop lifting platform, wherein the desktop lifting platform comprises a lifting column, and a supporting plate that rises or descends with the lifting column; the hindered-to-flip-up structure is disposed on the supporting plate; the supporting plate includes a fixing plate and a flip plate in rotatable connection with the fixing plate; a limiting device is provided on the supporting plate; when the flip plate rotates downwardly, the limiting device limits the flip plate from downward rotation; the flip plate is free to rotate upwardly.

The present disclosure has the following beneficial effects:

In the present disclosure, because the flip plate is in rotatable connection with the fixing plate while downward rotation of the flip plate is limited by a limiting device, an item placed on the flip plate does not topple over due to the self-weight of the item. The flip plate is not limited from upward rotation. When the flip plate moves downwardly to touch the item on the desk, the flip plate flips upwardly, preventing crushing the item and meanwhile protecting the desktop lifting platform.

According to the embodiment of the present disclosure, the limiting device includes an upper arcuate plate and a lower arcuate plate, wherein the upper arcuate plate is provided at the bottom of the fixing plate, and the lower arcuate plate is provided at the top of the flip plate, the fixing plate and the flip plate being rotatably connected via a rotating shaft, the upper arcuate plate and the lower arcuate plate surrounding two sides of the rotating shaft, such that in a free state, when the lower arcuate plate rotates downwardly, the upper arcuate plate and the lower arcuate plate abutting with each other along the perimeter of the rotating shaft.

According to the embodiment of the present disclosure, the upper arcuate plate includes a first upper end face and a first lower end face, and the lower arcuate plate includes a second upper end face and a second lower end face, wherein in a free state, the second lower end face on the lower arcuate plate abuts the first end face of the upper arcuate plate.

According to the embodiment of the present disclosure, in a free state, when the lower arcuate plate rotates upwardly, a circumferential gap exists between the upper arcuate plate and the lower arcuate plate.

According to the embodiment of the present disclosure, the upper arcuate plate includes a first upper end face and a first lower end face, and the lower arcuate plate includes a second upper end face and a second lower end face, wherein in a free state, a circumferential gap exists between the second upper end face of the lower arcuate plate and the first upper end face of the upper arcuate plate.

According to the embodiment of the present disclosure, the flip plate includes a horizontal plate and a tilted plate intersected with the horizontal plate, the tilted plate and the fixing plate being in rotatable connection, and the included angle $\alpha$ between the horizontal plate and the tilted plate being greater than 90°.

The present disclosure further provides a desktop lifting platform, comprising a lifting column and a base, wherein the base is disposed or installed on a work platform, and the desktop lifting platform further comprises a supporting plate rising or descending with the lifting column, wherein the supporting plate is provided with the hindered-to-flip-up structure described in any solution above.

According to the embodiment of the present disclosure, the supporting plate is further connected with a desktop board.

These characteristics and advantages of the present disclosure will be disclosed in detail in the preferred embodiments below with reference to the accompanying drawings.

BRIEF DESCRIPTION OF THE DRAWINGS

Hereinafter, the present disclosure will be described in further detail with reference to the accompanying drawings.

DESCRIPTION OF THE EMBODIMENTS

Figure 1:
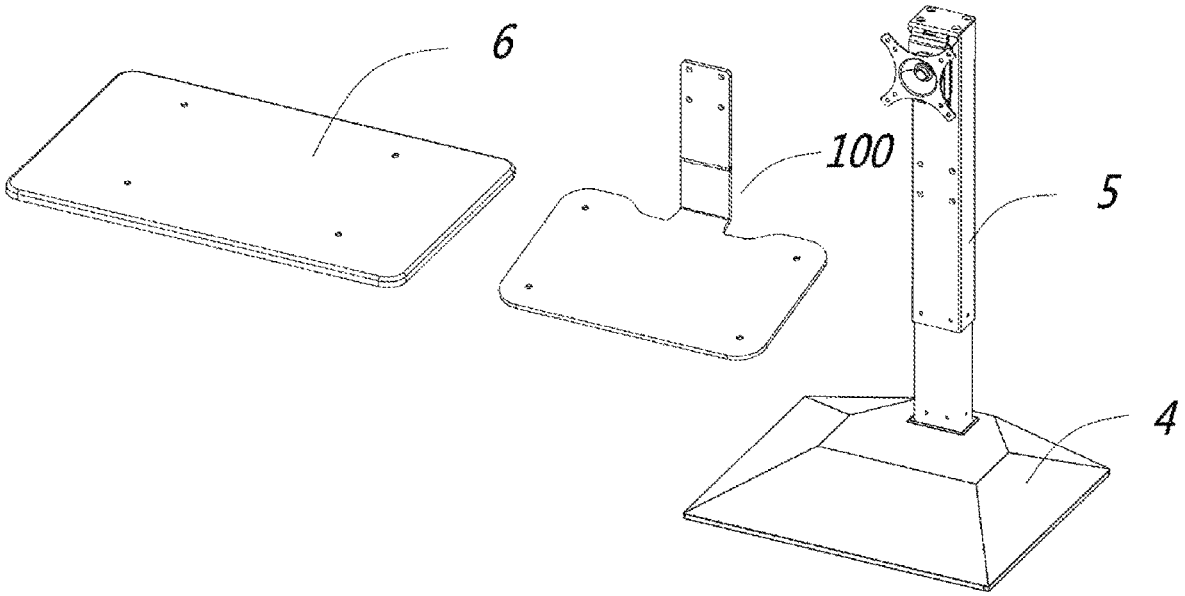
FIG. 1 shows a structural schematic diagram of a desktop lifting platform according to the present disclosure.
Figure 2:
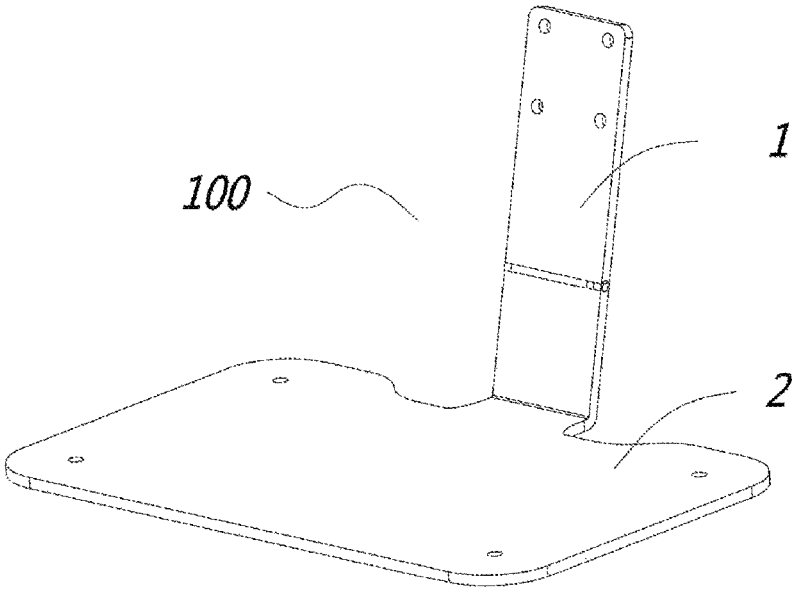
FIG. 2 shows a structural schematic diagram of a supporting plate in the present disclosure.

Hereinafter, the technical solutions of the embodiments of the present disclosure will be explained and illustrated with reference to the accompanying drawings corresponding to the embodiments of the present disclosure. However, the embodiments are only preferred embodiments of the present disclosure, not all of them. Other embodiments obtained by those skilled in the art without exercise of inventive work based on the examples in the embodiments all fall within the protection scope of the present disclosure.

In the description below, the orientation or position relationships indicated by the terms "inner," "outer," "upper," "lower," left," and "right," etc. are intended only for facilitating or simplifying description of the present disclosure, not for indicating or implying that the devices or elements have to possess those specific orientations and have to be configured and operated with those specific orientations; therefore, they should not be understood as limitations to the present disclosure.

Embodiment 1

As shown in FIGS. 1 to 6, a desktop lifting platform is provided. In this embodiment, the desktop lifting platform is mainly disposed on a work platform like a desk. The desktop lifting platform in this embodiment comprises a base 4 and a lifting column, and the desktop lifting platform further comprises a supporting plate 100 which is driven by the lifting column 5 to rise or descend. The supporting plate 100 in this embodiment is provided with a hindered-to-flip-up structure 200, the supporting plate 100 comprises a fixing plate 1 and a flip plate 2 in rotatable connection with the fixing plate. The flip plate 2 is limited by a limiting device from downward rotation, such that items like a keyboard may be directly disposed on the flip plate 2. Alternatively, a desktop board 6 may be separately provided. The desktop board 6 is fixedly assembled on the flip plate 2, while the fixing plate may be directly mounted on the lifting column 5. A display may also be mounted on the lifting column 5.

Figure 3:
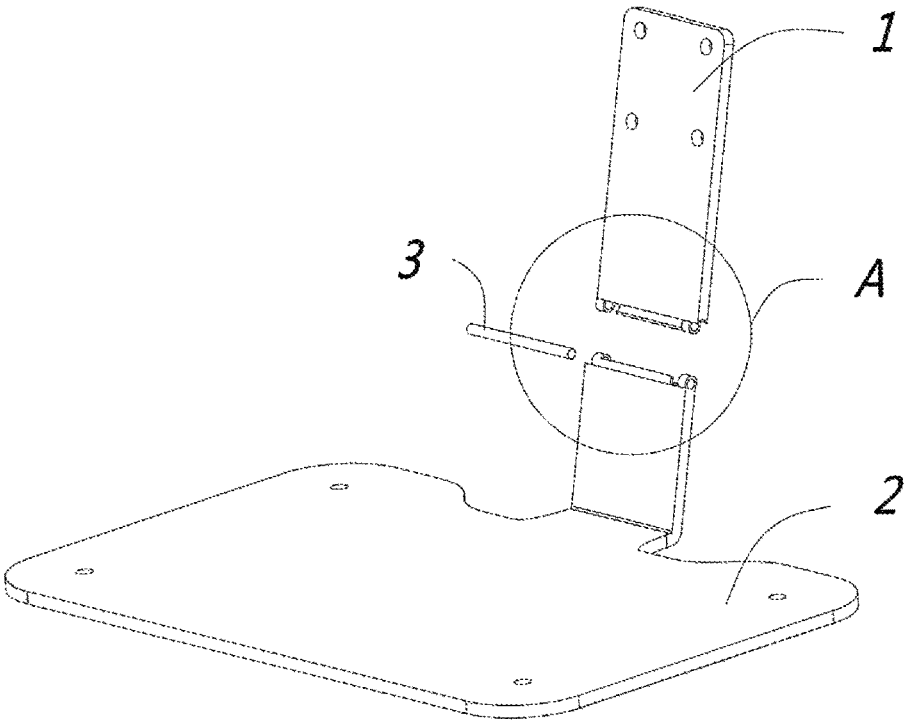
FIG. 3 shows an explosive schematic diagram of a supporting plate in the present disclosure.
Figure 4:
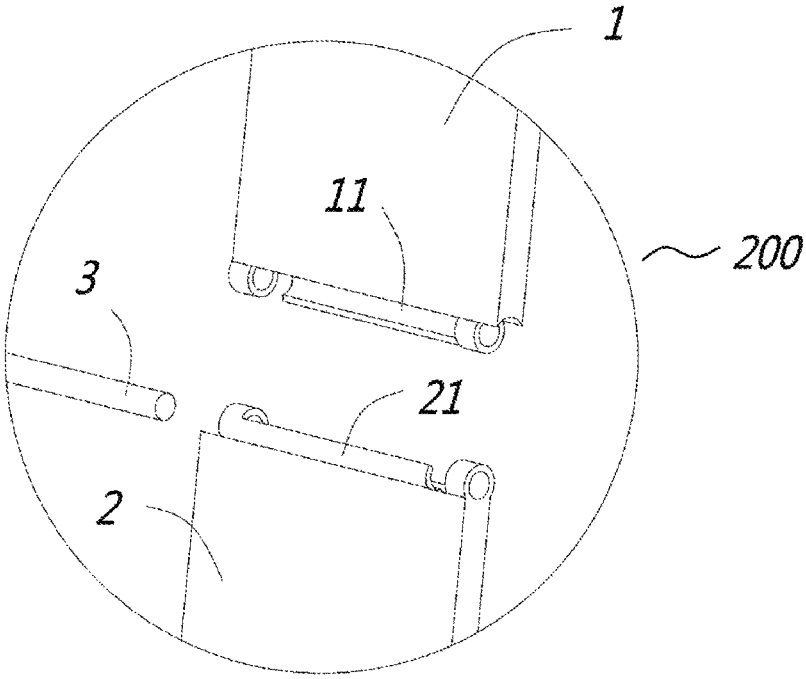
FIG. 4 is an enlarged view of part A in FIG. 3.

The hindered-to-flip-up structure 200 in this embodiment is shown in FIG. 3 and FIG. 4:

In this embodiment, the limiting device includes an upper arcuate plate 11 and a lower arcuate plate 21, wherein the upper arcuate plate 11 is provided at the bottom of the fixing plate 1, and the lower arcuate plate 21 is provided on the top of the flip plate 2, the fixing plate 1 and the flip plate 2 being rotatably connected via a rotating shaft 3, the upper arcuate plate 11 and the lower arcuate plate 21 surrounding two sides of the rotating shaft 3.

Figure 5:
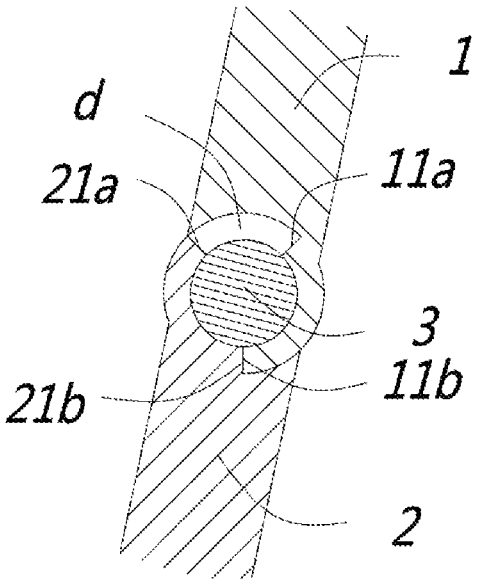
FIG. 5 shows a sectional view of a junction portion between the fixing plate and the flip plate in the present disclosure.
Figure 6:
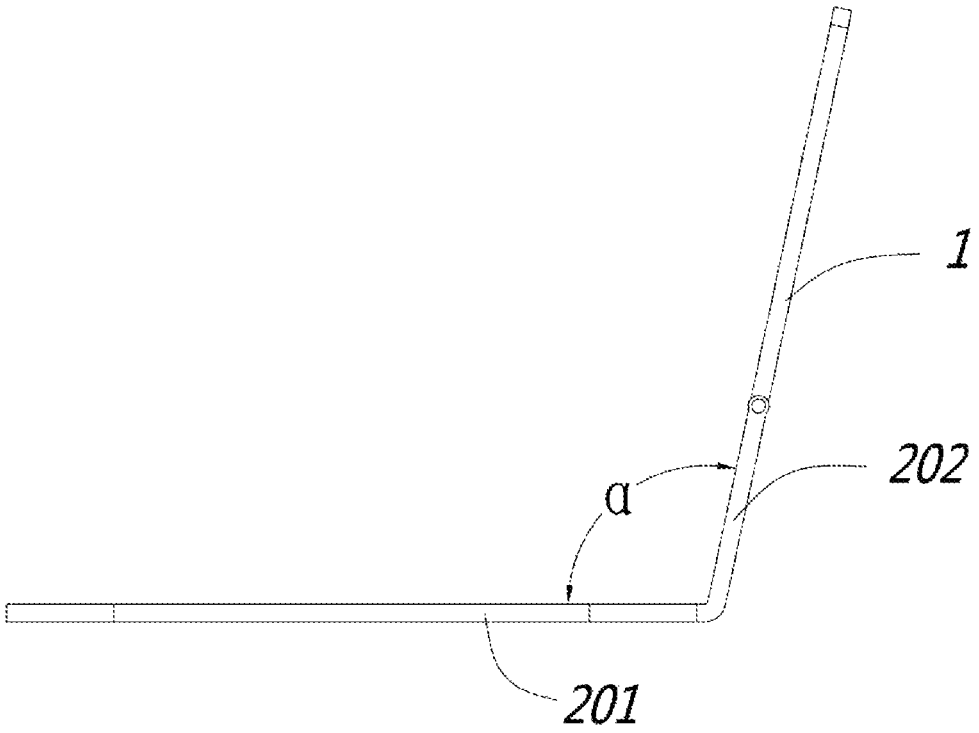
FIG. 6 shows a lateral schematic diagram of the supporting plate in the present disclosure.

Particularly, the upper arcuate plate 11 includes a first upper end face 11*a* and a first lower end face 11*b*, and the lower arcuate plate 21 includes a second upper end face 21*a* and a second lower end face 21*b*, as shown in FIG. 5, wherein in a free state, owing to self-weight of the flip plate 2, the second lower end face 21*b* on the lower arcuate plate 21 abutting the first lower end face 11*b* of the upper arcuate plate 11, such that the flip plate 2 cannot further rotate counterclockwise.

Further, in a free state, a circumferential gap d exists between the second upper end face 21*a* of the lower arcuate plate 21 and the first upper end face 11*a* of the upper arcuate plate 11. Due to existence of the gap d, when the flip plate 2 is subjected to an upward acting force, the upper arcuate plate 11 will rotate clockwise, naturally achieving the objective of flipping the flip board 2 upwardly when being hindered.

Additionally, in the embodiment shown in FIG. 65, the flip plate 2 comprises a horizontal plate 201 and a flip plate 202, wherein the included angle $\alpha$ between the horizontal plate 201 and the tilted plate 202 is preferably greater than 90°; because if the included angle $\alpha$ is less than or equal to 90°, when the flip plate 2 is subjected to an acting force, it is possible that the flip plate 2 is driven to rotate counterclockwise, while due to being limited by the limiting device, the flip plate 2 cannot rotate counterclockwise; in this case, if the flip plate 2 is continuously driven to rotate counterclockwise, it easily causes the electric motor to be overloaded, thereby damaging the desktop lifting platform.

What have been described above are only preferred embodiments of the present disclosure; however, the protection scope of the present disclosure is not limited thereto. A person skilled in the art should understand that the present disclosure includes, but not limited to the contents described in the drawings and the preferred embodiments. Any modifications without departing from the functions and structural principles of the present disclosure will be included within the scope of the claims.

What is claimed is:

1. A hindered-to-flip-up structure for a desktop lifting platform, wherein the desktop lifting platform comprises a lifting column, and a supporting plate that rises or descends with the lifting column; the hindered-to-flip-up structure is disposed on the supporting plate; the supporting plate comprises a fixing plate and a flip plate in rotatable connection with the fixing plate; a limiting device is provided on the supporting plate; when the flip plate rotates downwardly, the limiting device limits the flip plate from downward rotation; the flip plate is free to rotate upwardly, wherein the limiting device comprises an upper arcuate plate and a lower arcuate plate, the upper arcuate plate is provided at a bottom of the fixing plate, and the lower arcuate plate is provided at a top of the flip plate, the fixing plate and the flip plate are rotatably connected via a rotating shaft, such that in a free state, when the lower arcuate plate rotates downwardly, the upper arcuate plate and the lower arcuate plate abut with each other along a perimeter of the rotating shaft, and in the free state, when the lower arcuate plate rotates upwardly, a circumferential gap exists between the upper arcuate plate and the lower arcuate plate.

2. The hindered-to-flip-up structure for the desktop lifting platform according to claim 1, wherein the upper arcuate plate and the lower arcuate plate surround two sides of the rotating shaft.

3. The hindered-to-flip-up structure for the desktop lifting platform according to claim 1, wherein the upper arcuate plate comprises a first upper end face and a first lower end face, and the lower arcuate plate comprises a second upper end face and a second lower end face, wherein in the free state, the second lower end face on the lower arcuate plate abuts the first lower end face of the upper arcuate plate.

4. The hindered-to-flip-up structure for the desktop lifting platform according to claim 1, wherein the upper arcuate plate comprises a first upper end face and a first lower end face, and the lower arcuate plate comprises a second upper end face and a second lower end face, wherein in a free state, a circumferential gap exists between the second upper end face of the lower arcuate plate and the first upper end face of the upper arcuate plate.

5. The hindered-to-flip-up structure for the desktop lifting platform according to claim 1, wherein the flip plate comprises a horizontal plate and a tilted plate intersected with the horizontal plate, the tilted plate and the fixing plate are in rotatable connection, and an included angle α between the horizontal plate and the tilted plate is greater than 90°.

6. A desktop lifting platform, comprising a lifting column, a base and a supporting plate rising or descending with the lifting column, wherein the base is disposed or installed on a work platform, the supporting plate is provided with a hindered-to-flip-up structure, the supporting plate comprises a fixing plate and a flip plate in rotatable connection with the fixing plate; a limiting device is provided on the supporting plate; when the flip plate rotates downwardly, the limiting device limits the flip plate from downward rotation; the flip plate is free to rotate upwardly, wherein the limiting device comprises an upper arcuate plate and a lower arcuate plate, the upper arcuate plate is provided at a bottom of the fixing plate, and the lower arcuate plate is provided at a top of the flip plate, the fixing late and the flip plate are rotatably connected via a rotating shaft, such that in a free state, when the lower arcuate plate rotates downwardly, the upper arcuate plate and the lower arcuate plate abut with each other along a perimeter of the rotating shaft, and in the free state, when the lower arcuate plate rotates upwardly, a circumferential gap exists between the upper arcuate plate and the lower arcuate plate.

7. The desktop lifting platform according to claim 6, wherein the upper arcuate plate and the lower arcuate plate surround two sides of the rotating shaft.

8. The desktop lifting platform according to claim 6, wherein the upper arcuate plate comprises a first upper end face and a first lower end face, and the lower arcuate plate comprises a second upper end face and a second lower end face, wherein in the free state, the second lower end face on the lower arcuate plate abuts the first lower end face of the upper arcuate plate.

9. The desktop lifting platform according to claim 6, wherein the upper arcuate plate comprises a first upper end face and a first lower end face, and the lower arcuate plate comprises a second upper end face and a second lower end face, wherein in a free state, a circumferential gap exists between the second upper end face of the lower arcuate plate and the first upper end face of the upper arcuate plate.

10. The desktop lifting platform according to claim 6, wherein the flip plate comprises a horizontal plate and a tilted plate intersected with the horizontal plate, the tilted plate and the fixing plate are in rotatable connection, and an included angle α between the horizontal plate and the tilted plate is greater than 90°.

* * * * *